United States Patent [19]

Bolson

[11] Patent Number: 4,564,889

[45] Date of Patent: Jan. 14, 1986

[54] HYDRO-LIGHT

[76] Inventor: Frank J. Bolson, Rte. #1, Box 86-#6, Cottonwood, Calif. 96022

[21] Appl. No.: 629,329

[22] Filed: Jul. 10, 1984

Related U.S. Application Data

[63] Continuation of Ser. No. 356,780, Nov. 10, 1982, abandoned.

[51] Int. Cl.[4] ..... F21V 31/00

[52] U.S. Cl. ..... 362/192; 362/96; 290/54

[58] Field of Search ..... 362/96, 192; 290/54

[56] References Cited

U.S. PATENT DOCUMENTS 3,845,291 10/1974 Purtyrata ..... 362/192

3,864,547 2/1975 Ray ..... 362/92

FOREIGN PATENT DOCUMENTS 715943 1/1942 Fed. Rep. of Germany ..... 362/192

725214 9/1942 Fed. Rep. of Germany ..... 362/192

*Primary Examiner*—Ronald H. Lazarus

*Attorney, Agent, or Firm*—Leonard Bloom

[57] ABSTRACT

A hydroelectric illumination source powered by a small alternator designed to provide underwater illumination or in-stream illumination such as for a shower head, fountain, or swimming pool. The water pressure from a direct line or recirculation pump is used to drive a small armature that produces an alternating current which illuminates a bulb operatively connected thereto.

1 Claim, 2 Drawing Figures

FIG 1
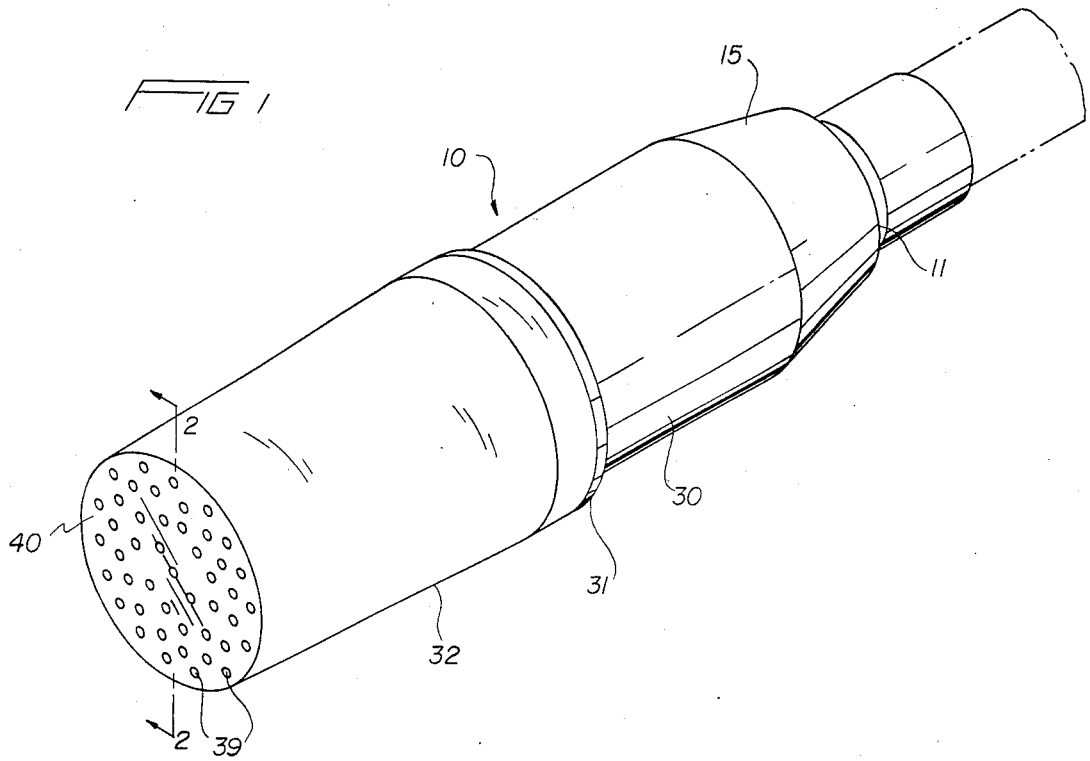
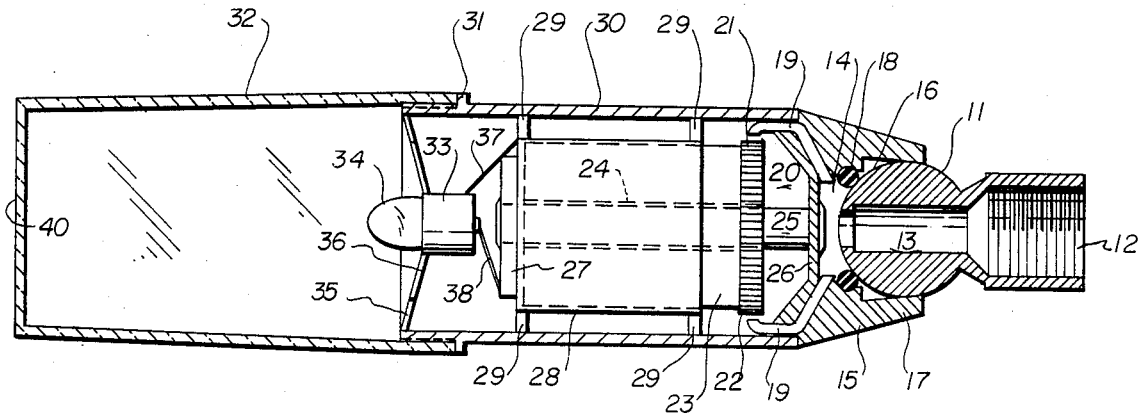
FIG 2

HYDRO-LIGHT

This application is a continuation of application Ser. No. 356,780 filed Nov. 10, 1982 now abandoned.

BACKGROUND OF THE INVENTION

This invention relates generally to a hydraulic power generating unit and specifically to an in-line alternator which generates power to a small light source to illuminate the area directly surrounding a shower head, water inlet or outlet in a hot tub or a swimming pool or the like.

It is often desirable to illuminate a stream of water or a body of water to create a decorative effect or provide underwater illumination. For example, it may be desirable to add colored light to the flow of water in a fountain or to illuminate a shower head, or the inlet port in a swimming pool. The water pressure supplied to the normal household is generally far greater than is necessary to supply the various requirements of the household. The pressure varies anywhere from 60 psi to 100 psi depending upon the relative altitude of the outlet in relation to the supply source. This excessive pressure ensures that all the systems in the complete circuit are amply supplied with an adequate amount of water. Therefore, this excess force can be employed to drive a small electrical generator as is provided in the instant application. Similarly, recirculating pumps provide excess pressure which can also be utilized.

In the past, in order to provide underwater illumination in a swimming pool or whirlpool, it was necessary to install a watertight electric light portal powered from an exterior source. Similarly, a shower head could not provide a source of light; therefore a separate lighting fixture was necessary to provide the desired illumination.

Employing the device according to the instant application allows one to illuminate a shower head, a fountain, a swimming pool, or any other body of water where a stream of water is pumped therethrough. The instant device is installed directly in the flow of the water being pumped and utilizes the flow to turn an alternator which is connected directly to an in-line light source. This device can be used anywhere where the water pressure from the inlet conduit is sufficient to drive a small alternator.

The following patents reflect the state of the art of which applicant is aware insofar as they appear to be germane to the patent process U.S. Pat. Nos.:

| | | | |
|---|---|---|---|
| 344,344 | Buell | 1,669,055 | Hogg |
| 1,982,315 | Lundberg | | |

Of the references cited the patent to Lundberg would appear to be the most germane of the three because the Lundberg device teaches the use of an illuminated lawn sprinkler in which water extending from a conduit to the outlet nozzle of the sprinkler contacts and rotates a generator which is operatively connected to a light bulb having a reflector and a cap on the top portion thereof. However, the Lundberg device requires a complex mechanical structure which includes a gear train for transmitting the rotational force to power the light, and the liquid is not sprayed coaxially with the light housing. Further, the rotating force of the Lundberg invention is through liquid forced through jets which are external of the generator structure.

The instant invention is distinguished in that it rotates its alternator structure through the direct force of a plurality of water jets impacting a vane drive which is integral with the rotating magnetic structure and requires no plurality of mechanical gears. Furthermore, the instant invention generates an alternating current whereas the Lundberg device generates a direct current power.

SUMMARY AND OBJECTS OF THE INVENTION

Accordingly, it is a primary object of the present invention to provide a novel hydroelectric illumination source which can be used in conjunction with a shower head to illuminate the area beneath the shower head.

It is another object of the present invention to provide a novel hydroelectric illumination source that can be used in conjunction with recirculating water systems such as whirlpools, tubs, or swimming pools to provide a unique source of underwater illumination.

It is a further object of the present invention to provide a novel hydroelectric illumination source which when used in conjunction with a fountain will decoratively illuminate in various colors the flow of water associated therewith.

It is still another object of the present invention to provide a novel hydroelectric illumination source which does not require complex mechanical transmissions in order to provide illumination.

It is a still further object of the present invention to provide a novel hydroelectric illumination source which is simple to manufacture and lends itself well to mass production techniques.

Still further objects and advantages of the present invention will become apparent from the following description when taken in conjunction with the accompanying drawing figures.

BRIEF DESCRIPTION OF THE DRAWING FIGURES

FIG. 1 is a perspective view of the device according to the instant application.

FIG. 2 is a sectional view of FIG. 1 taken along lines 2—2.

DESCRIPTION OF THE PREFERRED EMBODIMENT

Referring now to the drawings in detail wherein like reference numerals represent like parts throughout the several figures, reference numeral 10 refers generally to the device according to the instant application.

In a preferred embodiment of the invention, an adjustable inlet ball 11 is connected to a pressurized water source by means of threads 12 and pressurized water is admitted through an intake port 13 which admits pressurized water to an interior cavity 14. A first body portion 15 provides a socket area 16 that has a surrounding lip 17 which captures the ball 11 and allows adjustment of the entire body of the device. A rubber seal 18 in the body portion 15 prevents escape of pressurized water into the socket area 16. Two propulsion tubes 19 provide a means of egress for the pressurized water from the first cavity 14 to a second axially displaced cavity 20. The pressurized water is directed toward peripheral vanes 21 provided on a vaned drive wheel 22 which is fixed to an alternator armature 23. The armature 23 has a central bore 24 adapted to slip fit on a fixed shaft 25. The shaft 25 is supported on one end by an imperforate support web 26 which is part of the body of the socket 15 and carries all water to exit via tubes 19. On the other end, the shaft 25 is supported by a stator plate 27 which is part of a stator body 28. The stator body 28 surrounds the armature 23 and is supported front and rear by foraminous support web members 29 (constituting first and second support webs axially spaced relative to one another) which are part of a cylindrical main body 30 that defines in part cavity 20. The main body 30 has a peripheral lip 31 which acts as a stop for a lens cap 32 having an elongate cylindrical configuration covering an end of the main body 30 by a threaded friction fit and which registers with the lip 31.

A light socket 33 containing a light bulb 34 is supported in a fenestrated support web 35 (constituting a third support web) which has a reflector portion 36 and is supported at the most forward portion of the main body 30. Two wires 37 and 38 connect the light socket 33 to the armature and stator respectively so that the light bulb 34 receives an alternating current from the alternator. The lens cap 32 has an end wall 40 remote from intake port 13 provided with a series of apertures 39 FIG. 1 to allow for the egress of the water once it reaches that point. The light bulb 34 provides illumination in a direction substantially parallel with the flow of the pressurized water.

In use and operation, the hydro light is connected to a source of pressurized water by means of the threads 12 on the ball 11. When the pressurized water is turned on it enters through the intake port 13 into the first inner cavity 14. The pressurized water then travels through the propulsion tubes 19 which direct a stream of water at the peripheral arcuate vanes 21, on the drive wheel 22 which is fixed to the armature 23. This drives the armature 23 in a circular motion producing an electrical current which illuminates the light bulb 34 on an opposite end thereof. The water then travels through the cavity 20 of the body 30 passing through apertures in the supports webs 29. The water continues along this path passing through the further support webs 35 which surround the reflector 36 thereafter entering into the substantially-cylindrical elongated lens cap 32 (as shown more clearly in FIG. 2) which is provided with a series of apertures 39 a substantially flat in end wall 40 to allow the final egress of the water from the hydro light.

It should be noted that a series of various colored and/or reflective lens caps 32 can be used and that the ball 11 and socket 15 can receive adapters to allow the hydro light to be mounted to the apertures recycling water in a hot tub or a swimming pool.

Having thus described the preferred embodiment of the invention, it should be understood that numerous structural modifications and adaptations may be resorted to without departing from the spirit of the invention.

What is claimed is:

1. A hydro-light, comprising a main body having a substantially longitudinal axis and further having forward and rearward end portions, a pair of support webs within the body and constituting first and second support webs axially spaced relative to one another, an electrical generator including a stator mounted within the first and second support webs, the generator further including an armature within the stator, a vaned wheel in the main body rearwardly of the generator and arranged for driving the armature, means for accommodating water flow into the rearward end portion of the body, against the vaned wheel and axially of the body, and through the first and second support webs between the generator and the body, a third support web mounted substantially on the forward end portion of the body, the third support web including a reflector portion and having an opening therein for flow of water therethrough, a light bulb mounted in a socket on the reflector and connected to the generator, a substantially-cylindrical elongated lens cap mounted on the forward end portion of the body, and the lens cap having a substantially flat end wall provided with a plurality of apertures for flow of water therethrough, thereby providing a substantially fine spray illuminated by the light radiating from the bulb.

* * * * *